United States Patent [19]

Jaworski

[11] Patent Number: 4,853,987

[45] Date of Patent: Aug. 8, 1989

[54] UNITIZED HYDROTHERAPY JET AND PUMP ASSEMBLY

[76] Inventor: William R. Jaworski, 7909 Penn Ave. N., Minneapolis, Minn. 55444

[21] Appl. No.: 95,909

[22] Filed: Sep. 14, 1987

[51] Int. Cl.[4] ..... A61H 33/02

[52] U.S. Cl. ..... 4/542; 4/509; 4/544

[58] Field of Search ..... 4/542, 543, 544, 507, 4/509, 492, 541, 570

[56] References Cited

U.S. PATENT DOCUMENTS

| | | | |
|---|---|---|---|
| 2,417,499 | 3/1947 | Ille | 4/452 |
| 2,738,787 | 3/1956 | Jacuzzi et al. | 128/66 |
| 3,159,849 | 12/1964 | Jacuzzi | 4/542 |
| 3,273,560 | 4/1966 | Jacuzzi | 128/66 |
| 3,287,741 | 11/1966 | Nash | 4/544 |
| 3,297,025 | 1/1967 | Jacuzzi | 128/66 |
| 3,940,807 | 3/1976 | Baker et al. | 4/490 |
| 4,115,878 | 9/1978 | Johnson et al. | 4/492 |
| 4,168,705 | 9/1979 | Raab | 4/507 X |
| 4,330,412 | 5/1982 | Frederick | 210/805 |
| 4,349,434 | 9/1982 | Jaworski | 128/66 |
| 4,420,846 | 12/1983 | Bonner | 4/542 |
| 4,525,881 | 7/1985 | Higginbotham | 4/496 |
| 4,665,572 | 5/1987 | Davidson et al. | 4/542 X |
| 4,742,584 | 5/1988 | Abe | 4/542 |

*Primary Examiner*—A. D. Pellinen
*Assistant Examiner*—Morris Ginsburg
*Attorney, Agent, or Firm*—James V. Harmon

[57] ABSTRACT

A unitized hydrotherapy jet and pump assembly includes a housing having a mouth portion connected to and communicating through the wall of a hot tub, spa, bathtub, whirlpool or pool with the interior of the tub below the water line. In the mouth of the jet and pump assembly is a hydrotherapy jet nozzle outlet and a water inlet positioned adjacent to each other. A water pump within the assembly communicates between the water inlet and the jet outlet. A motor is connected to the pump to energize the pump for drawing water into the unit through the water inlet and expelling a stream of water back into the tub through the hydrotherapy jet.

14 Claims, 5 Drawing Sheets

FIG. 6
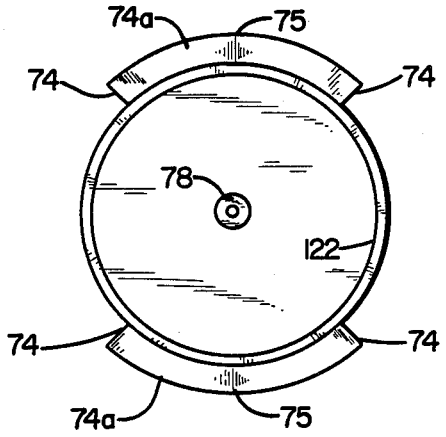
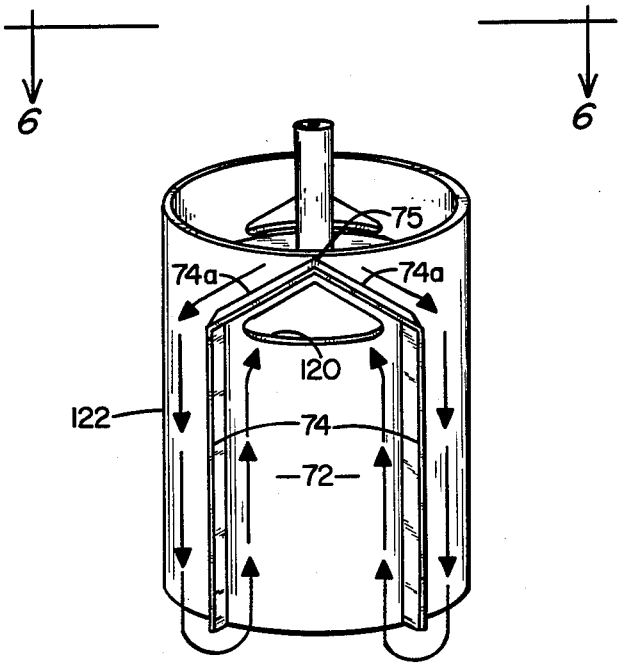
FIG. 5

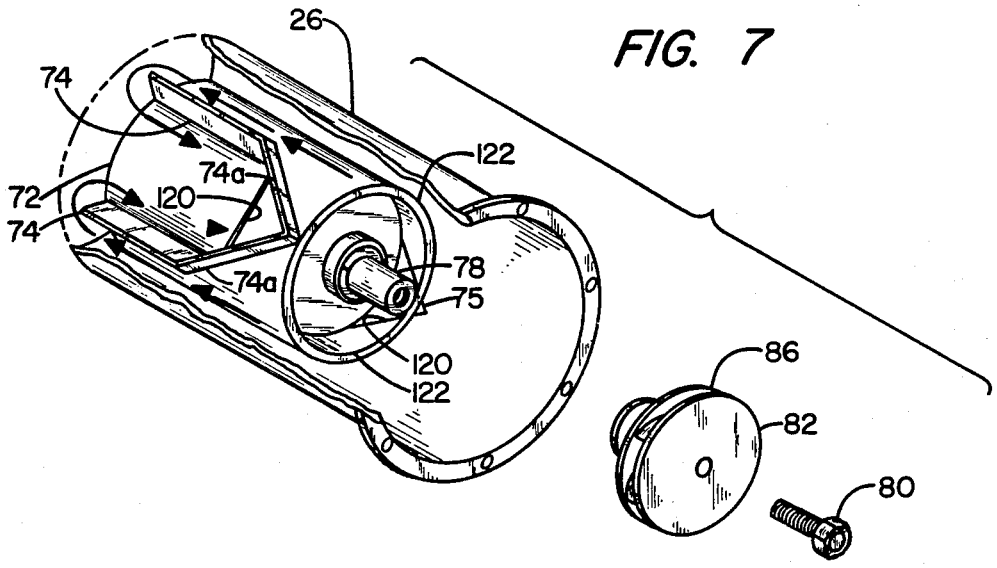
FIG. 7
FIG. 8
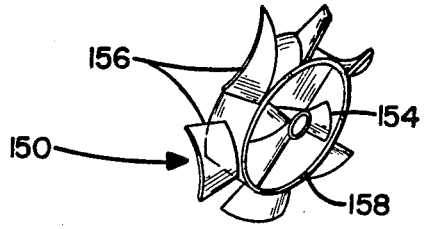
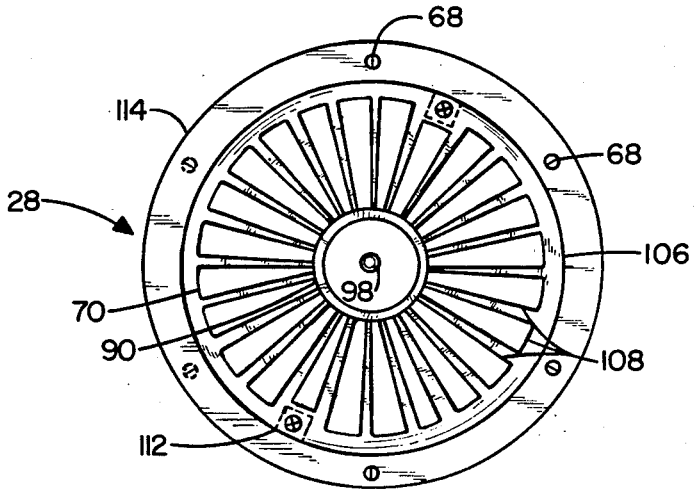
FIG. 9

UNITIZED HYDROTHERAPY JET AND PUMP ASSEMBLY

FIELD OF THE INVENTION

The present invention relates to hydrotherapy and more particularly to an improved hydrotherapy jet and pump assembly.

BACKGROUND OF THE INVENTION

One early hydrotherapy system consisted of a drive motor mounted on the exterior of a tub and connected to a pump within the tub by means of a drive belt extending over the edge of the tub. U.S. Pat. No. 2,417,499 proposes a similar arrangement in which a motor is mounted above the tub on a bracket suspended on one wall of the tub and connected via a vertical shaft to an impeller located in the interior of the tub. These devices get in the way of the user, present a poor appearance, require a great deal of space both inside and outside the tub, are complicated in construction and include a number of parts that are subject to wear and possible malfunction and have other disadvantages. In recent years the hydrotherapy industry has almost universally adopted an arrangement in which a single pump is connected by means of rigid polyvinylchloride pipe and pipe fittings to a plurality of hydrotherapy jets located at various points around the periphery of the tub. These installations are not only expensive because of the plumbing and assembly required but in addition there are substantial frictional .losses within the pipe and fittings which rob power and reduce efficiency. Moreover, the entire plumbing system must be leak tested before the unit leaves the factory. Once in the home, access doors are required around the tub for waste and overflow, for servicing the pump, etc., and the plumbing. Furthermore, the pump and motor require a fairly large space under the skirt of the tub which is a major disadvantage for installations in homes which often have limited room. In addition, because the water circulates through exteriorally located pipes, it cools off more quickly thus wasting heat. Since a single suction opening with a high velocity inlet area is used for a number of jets, there have also been problems with parts of the body or hair being drawn against or into a suction fitting (see U.S. Pat. No. 4,596,656 by Higginbotham and Jaworski). This can be uncomfortable or even dangerous.

In view of these and other deficiencies of the prior art it is one object of the present invention to provide an improved hydrotherapy jet and pump assembly which will overcome the aforesaid deficiencies, which will not be in the way of the user, which is attractive in appearance and in which there is minimal water circulation outside the confines of the hot tub, spa, bathtub, whirlpool or pool.

A further object is to provide an improved hydrotherapy pump and jet assembly which furnishes substantially the same hydrotherapy effect for the user of the tub as the units in current use but requires no external plumbing, allows servicing from inside the tub and at the same time keeps the pump and pump motor out of the way of the user and hidden from view. A further object is to provide a system for automatically reducing the harmful or uncomfortable suction that results when a portion of the body comes close to the water suction inlet, increasing pumping efficiency, reducing heat loss and assisting in heating the water being pumped.

These and other more detailed and specific objects of the present invention will be described in more detail in the accompanying figures and specification which illustrate a few preferred forms of the invention by way of example.

SUMMARY OF THE INVENTION

Briefly, the present invention provides a hydrotherapy jet and water pump assembly or unit for use in a hot tub, spa, bath tub, whirlpool or pool. In this unit a hydrotherapy pump and a hydrotherapy jet are combined in a self-contained or unitized device. The assembly is preferably mounted through a hole in the wall of the hot tub, spa, bath tub, whirlpool or pool and extends outwardly from the wall; i.e., away from the interior of the tub. When installed, the assembly is adapted to be sealed in the hole below the functional water line, that is to say below the surface level of the water during use. The unit comprises a casing., a pump, a pump motor and a hydrotherapy jet outlet, and water inlet and air inlet means. The jet outlet and the water inlet are both located at the mouth of the casing adjacent to the hole in the tub wall and both communicate with the interior of the tub, bath tub, whirlpool, spa or pool. The mouth of the hydrotherapy assembly can include a flange or other mounting means at irs edge for connecting and supporting the entire assembly from the wall of the tub.

THE FIGURES

FIG. 5 is a view similar to FIG. 4 showing in more detail the flow of water over the motor.

FIG. 6 is an end view taken on line 6—6 of FIG. 5.

FIG. 7 is an exploded perspective view of the pump and motor assembly portion of the unit of FIG. 3.

FIG. 8 is a perspective view of the impeller and associated structure of the type used in FIGS. 4–6 and FIG. 9 is an elevational view taken on line 9—9 of FIG. 3.

DETAILED DESCRIPTION OF THE INVENTION

Figure 1:
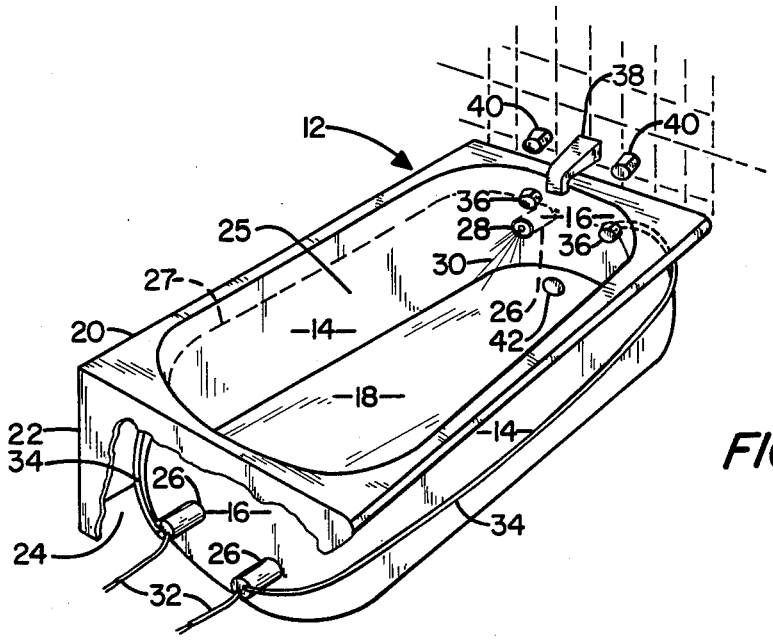
FIG. 1 is a perspective view showing a typical installation of the invention in a drain and fill tub in the nature of a conventional bathtub.

Refer now to the figures and particularly to FIG. 1 which illustrates a drain and fill type tub having a tub body 12 with four walls 14 and 16 and a bottom wall 18. The tub body 12 includes a horizontal top flange portion 20 that extends outwardly from the top of the walls 14 and 16. An enclosure 22 is provided around the tub. The enclosure 22 which is broken away in the drawings provides a space 24-extending around the entire tub to accommodate the hydrotherapy units or assemblies 26 to be described in more detail below. As seen in FIG. 1 the hydrotherapy units 26 project outwardly from the wall of the tub and in this case they are supported from, i.e., cantilevered from, the wall. It can also be seen that the hydrotherapy units 26 are not in the way since they are concealed entirely within the storage space 24 between the enclosure 22 and the walls of the tub.

The hydrotherapy units 26 communicate through the wall of the tub with the interior of the tub 25 in which water is held below the functional water line 27, i.e., the normal level of the water in the tub when the tub is filled and in use. Each hydrotherapy unit 26 is provided with a wall fitting 28 that defines a mouth 70 for the assembly (only one of which is visible in FIG. 1) and it is through the wall fitting 28 and the mouth 70 that the hydrotherapy units 26 forcefully expel a jet of water 30 into the interior of the tub for hydrotherapy purposes to provide a pleasant, massaging action for the user. The hydrotherapy units 26 include drive motors described below to which electric current is supplied through conductors 32. Air is supplied to the hydrotherapy units through tubes such as flexible plastic air tubes 34. The flow of air through the air tubes 34 can be controlled if desired by means of air flow control valves 36. This enables the user to increase or reduce the amount of air supplied to the hydrotherapy units 26 as desired to control the characteristics, e.g., the massaging characteristics, of the jet 30. Water is supplied to the tub through a tap 38 having water valves 40. During use, the tub is filled to a functional level 27 above the wall fittings 28. The hydrotherapy units 26 are then operated while the tub is in use. Following use the tub is drained through a water outlet 42.

Figure 2:
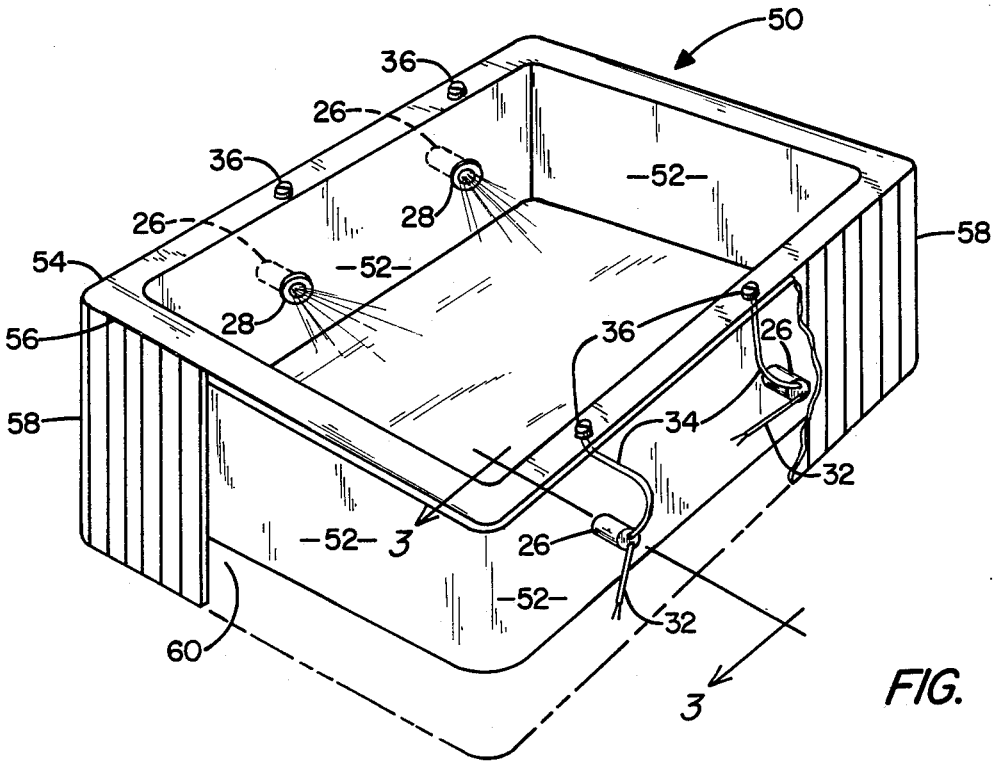
FIG. 2 is a perspective view partly broken away showing a typical installation of the invention in a hot tub or spa of the type which is normally kept filled with water after use.

Refer now to FIG. 2 which illustrates another application of the invention wherein the same numbers refer to corresponding parts already described. FIG. 2 illustrates the application of the invention in a hot tub or spa 50 which is not drained and filled after each use but is instead kept full of water over an extended period of time. As shown in the figure, the spa 50 includes side walls 52 which terminate at their upper edges in a horizontally disposed outwardly extending flange 54 that serves as the side edge of the spa. Extending downwardly from the outer edge 56 of the flange 54 is a skirt 58 to define a storage space ,60 between itself and the tub wall 52. It is in the space 60 that each of the hydrotherapy units 26 is enclosed. It will be seen that the entire hydrotherapy unit is concealed within the space 60 and will thus be out of the way when the users enter and leave the tub. As in the case of the drain and fill tub, electric current is supplied to the hydrotherapy units 26 through conductors 32 and air is controlled by valves 36 connected to hydrotherapy units 26 via plastic tubes 34. In the form shown, the hydrotherapy units 26 are supported entirely and exclusively by the tub wall 52. Accordingly, in this form of the invention no additional external supporting structure is required. External supplemental support can however be provided if desired. While FIG. 2 illustrates a spa., the invention can be applied in a similar manner to any other type of hydrotherapy installation such as a pool or wooden tub in which case only the dimensions of the installation differ. The principles of operation and the hydrotherapy units 26 are, however, the same.

Figure 3:
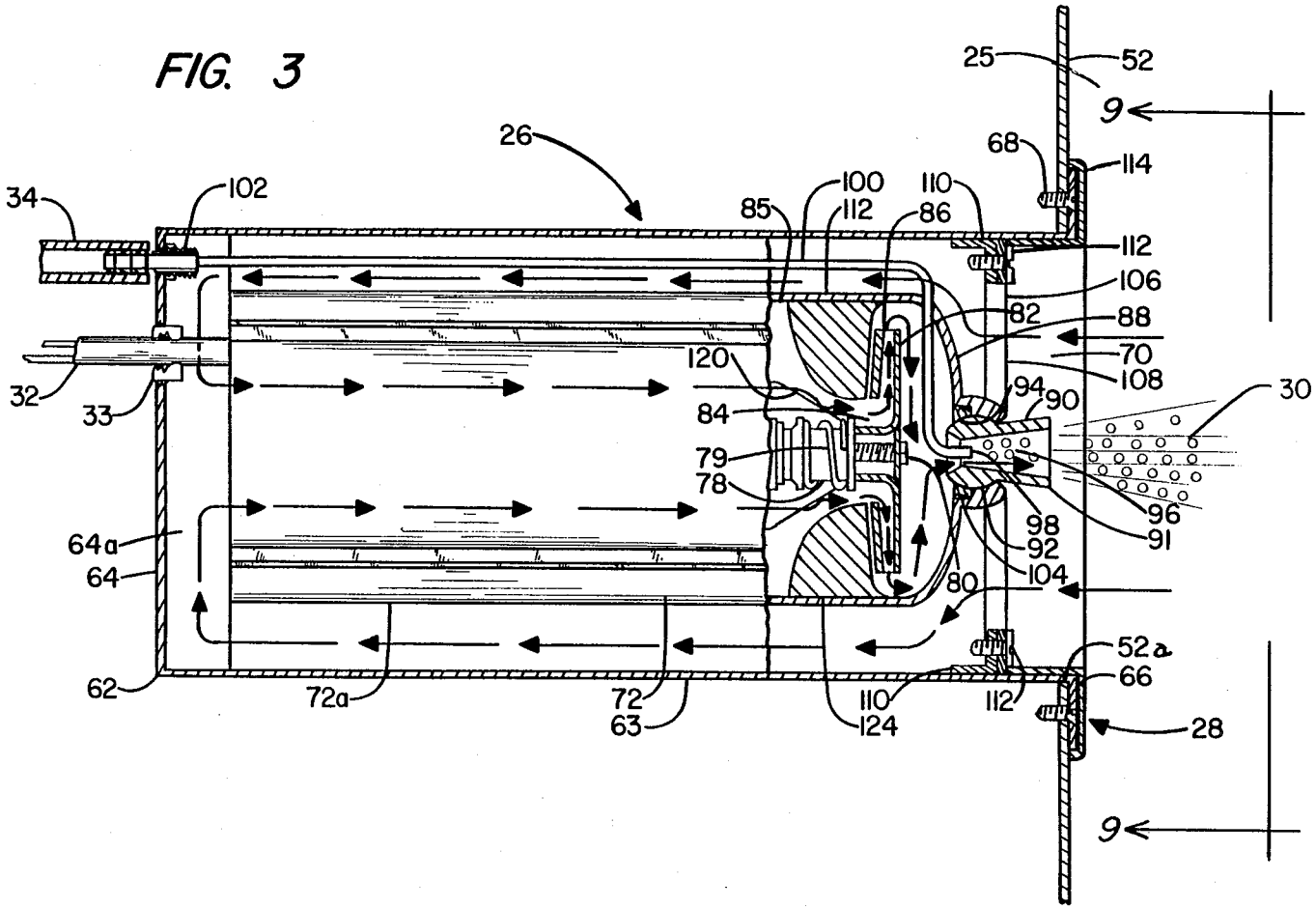
FIG. 3 is an enlarged cross-sectional view through the hydrotherapy jet and pump assembly taken on line 3—3 of FIG. 2.

Refer now to FIG. 3 which illustrates a vertical cross-sectional view of the hydrotherapy unit 26 shown in FIGS. 1 and 2. As seen in FIG. 3 the hydrotherapy unit 26 includes a housing or casing 62 which in this case includes a cylindrical side wall 63, an end wall 64 and a circular peripherally extending radially projecting and vertically disposed mounting flange 66 which is secured to the tub wall 52 within a mounting hole **52*a* by means of circumferentially spaced mounting screws 68. A rubber gasket (not shown) can be provided between flange 66 and the wall 52 of the tub to assure a waterproof seal. It can be seen that the housing 62 has an open mouth 70 at its inner end and is closed at its outer end by means of the end wall 64. In this way the housing 62 communicates with the interior 25 of the tub through the wall 52 and provides a hermetically sealed compartment or chamber to, define the outside casing of the entire hydrotherapy assembly 26. It should also be noted that water does not circulate outside of the confines of the housing 62.. As a result the hydrotherapy unit 26** can be thought of as self-contained.

Within the hydrotherapy unit 26 is a drive motor 72 such as a suitable electric motor to which current is supplied through the conductor 32. The motor is supported by means of circumferentially spaced apart laterally disposed and longitudinally extending flanges 74 which function as partitions or baffles extending from the wall 63 of the housing 62 to the outside wall **72*a* of the motor 72 thus holding the motor 72 securely in place within the housing 62**.

The motor 72 has an output shaft 78 maintained watertight by means of a suitable seal such as a compression seal including a helical compression spring 79. Rigidly connected to the end of the shaft 78 by means of a bolt 80 is a centrifugal pump impeller 82 having a mouth or inlet 84 for drawing water and for expelling it at the periphery through an outlet 86. From the impeller outlet 86 the water travels centrally through a pump housing 88 to a hydrotherapy outlet nozzle 90.

The nozzle 90 is mounted centrally within the mouth 70 of the hydrotherapy assembly 26 and includes an exterior spherical or ball surface 92 allowing the nozzle to be articulated in any direction within a spherical socket 94. The jet nozzle 90 preferably includes a tapered throat 96 having a reduced diameter or venturi portion located approximately at the mouth 98 of an air supply duct 100 that passes out of the impeller housing and communicates with the air supply tube 34 through a hose fitting 102. The term "nozzle" herein is used broadly to refer to a duct having an opening for expelling water into the tub or other vessel. The hydrotherapy jet nozzle 90 is held in place within the socket 94 by means of a threaded retaining ring 104, which is screw-threaded into the pump housing 88 adjacent to socket 94 to retain the ball 92 in place.

A water inlet is defined by a circular inlet screen 106 having inlet openings 108 around the entire periphery. Screen 106 is held in place upon mounting brackets 110 by means of mounting screws 112. An attractively polished escutcheon plate 114 covers the screws 68. The escutcheon plate 114 can be snap-fitted into place over the flange 66.

During operation, with the motor 72 energized, the pump impeller 82 will draw water .into the assembly through the openings 108 in the inlet screen 106. The water will pass longitudinally of the motor 72 and around the inner ends of the baffles 74 and centrally into a collection chamber 85 communicating with the inlet 84 of the pump impeller 82 through a pair of diametrically opposed openings 120 in a collar 122 surrounding motor shaft 78 which forms the sidewall of the collection chamber 85 between the motor 72 and the nozzle 90. A contoured throat 124 is provided adjacent the inlet 84 of the impeller 82 to guide the flow of water smoothly into the mouth 84 of the impeller 82.

Refer now to FIGS. 5 and 6 which illustrate in more detail the flanges 74 which serve as baffles for guiding the flow of water around the motor 72 from the inlet screen 106 to the impeller 82. As shown in the figures, adjacent pairs of baffles 74 are connected by terminal baffle portions 74*a* which are inclined toward one another and are connected together to form a peak 75. Thus, when the water is forced through the unit by the impeller 82, the flow divides at each of the two peaks 75 with half flowing outwardly on either side thereof until it reaches a space 64*a* just inside the end wall 64 whereupon the water reverses direction and passes inwardly again between the flanges 74. Upon reaching openings 120 in collar 122 the water passes inside the collar 122 and is directed into the mouth 84 of the impeller 82 by the contoured throat 124. The impeller 82 forced water centrifugally outward due to the rotation imparted to it by the electric motor. The water then flows centrally to the nozzle 90. When the water passes the end 98 of the air inlet duct 100, the reduced pressure in the venturi portion of the nozzle 90 will draw air into the rapidly moving stream of water. In this way the nozzle 90 expels a rapidly moving jet 30 of water and entrained air into the interior 25 of the tub to provide a hydrotherapy action for the benefit of the user.

While it is not essential for the water to flow over the walls of the motor 72 as described it has two important advantages. First, it prevents overheating of the motor 72, thereby eliminating the need for cooling air and associated cooling fan. In addition, it scavenges what would otherwise be waste heat and adds it to the water that is forced back into the tub 12 thereby helping to keep the water in the tub warm and improving the overall efficiency of the electric motor.

In a preferred form of the invention, a substantial amount of slack is provided in the flexible air tubes 34 of the conductors 32 so that when a repair has to be made, all that is necessary is to remove the escutcheon plate 114 and the screws 68. The entire hydrotherapy unit 26 can then be slid through the hole 52*a* (FIG. 3) into the interior of the tub for inspection and repair and the flexibility of the tube 34 and the conductor 32 will allow the hydrotherapy unit 26 to be moved about as required during repair. The conductor 32 is preferably connected to the motor by means of an electric disconnect plug 33 of suitable known construction.

Figure 4:
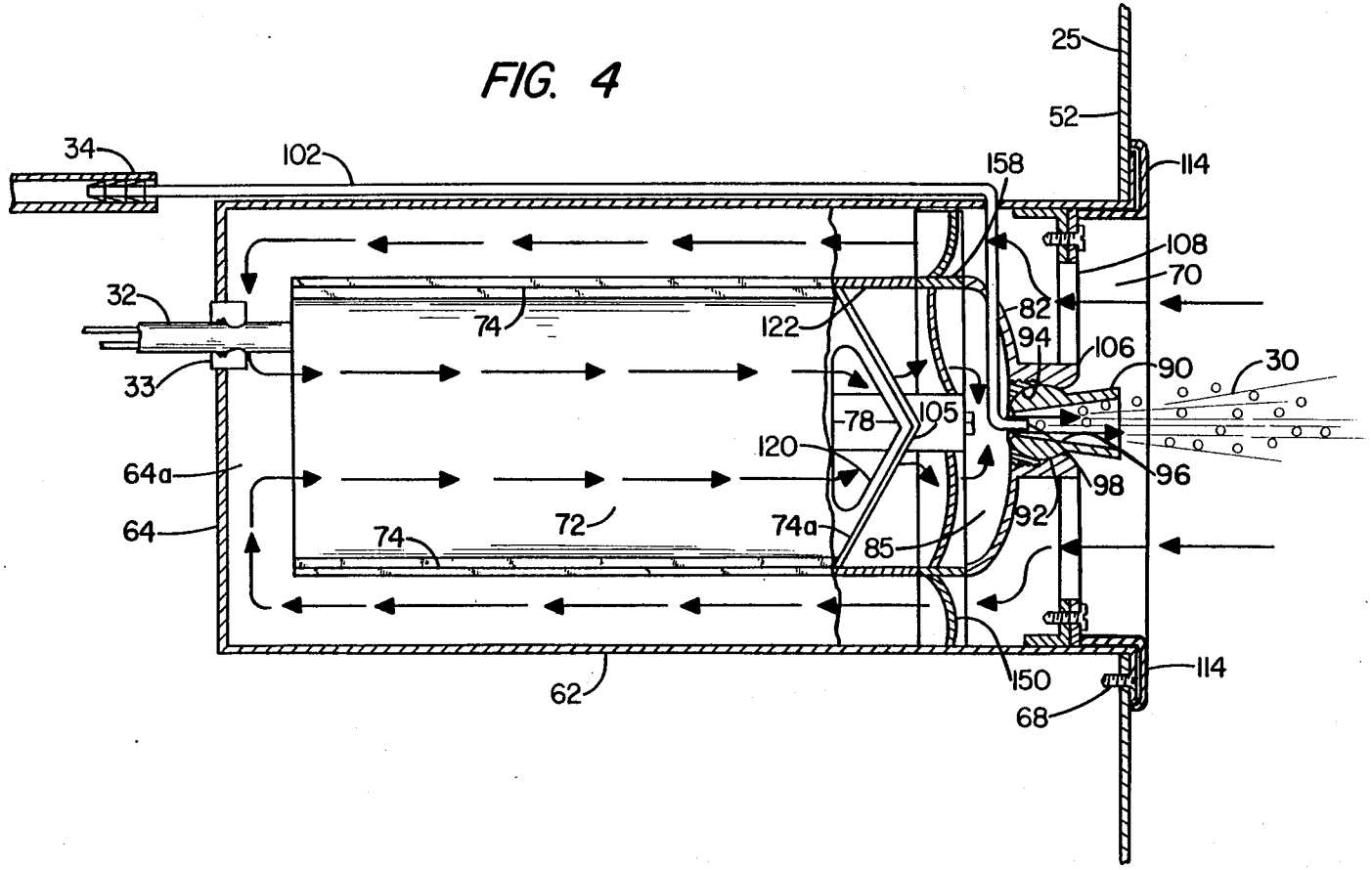
FIG. 4 is a view similar to FIG. 3 of a modified form of the invention.

Refer now to FIGS. 4 and 8 wherein the same numerals designate parts already described. The major differences between FIGS. 4 and 8 and prior figures is the nature of the water flow and the impeller which comprises a two stage multi-bladed axial flow impeller 150. Impeller 150 is secured to the motor shaft 78 by means of the bolt 80. It includes a set of centrally located blades 154 of one pitch, e.g., a positive pitch, adapted to draw water through the jet nozzle 90 and an external set of blades 156 having a pitch opposite that of the blades 154, i.e., negative, for propelling water toward the chamber 64*a* at the outer end of the unit 26. The internal and external blades are separated by an integral circumferentially extending axially aligned flow divider ring 158 that separates streams of water flowing in opposite directions on opposite sides thereof. The ring 158 is aligned between end wall 82, and collar 122.

When the motor is energized, the outer blades 156 as best seen in FIG. 4 will force the water outwardly between the housing 62 and the motor 72. The water will then pass into the chamber 64*a*, through the openings 120, into the collection chamber 85 surrounding the shaft 78, through the inner blades 154 and into the nozzle 90 which expels a jet 30 composed of water and entrained air into the interior 25 of the tub. One advantage of the impeller of FIGS. 4 and 8 is that it is able to use the entire cross-section of the hydrotherapy unit 26 for pumping purposes. Two stage pumping is also possible if blades 154 have a greater pitch than the first stage blade 156.

As described in connection with FIG. 3, heat is recovered from the motor 72. Although the motor 72 does not function as a primary heating means, the heat provided by the motor 72 will substantially reduce heat loss in small installations where the natural heat losses from the tub are of the same order as the heat provided by the motor, thus reducing the need for external heat and improving thermal efficiency. This can maintain a virtually stable and uniform temperature throughout operation.

Many variations are possible. It is possible, for example, to eliminate water circulation around the motor 72 and to depend upon other means of cooling.

Changes are also possible in the way air is supplied to the water stream expelled by nozzle 90. Air can be introduced at other locations. For example, it is possible to provide one or more radially extending air ducts through the blades of the impeller 150, to introduce air into these ducts near the center of the impeller, then to allow the air to exit through the trailing edge of the impeller on the low pressure side to ensure air entrainment within the stream of water passing over the impeller. This eliminates the need for the traditional venturi used for air aspiration. Numerous other modifications will be apparent.

The invention provides a number of important advantages. First it should be noted that no duct work is required around the tub through which water must be pumped. Moreover, in some installations using the invention no inspection or access doors around the tub are needed since each of the hydrotherapy units 26 can be withdrawn through the opening 52*a* in the tub wall 52 for servicing and inspection. Access is still needed on jetted bathtubs for waste and overflow piping not associated with the present invention. Cleaning of the screen or impeller can be done without removal of the pump; only the escutcheon and screen need to be removed. This is important because installations often require cleaning two or more times per year.

It should also be noticed that if a part of the body happens to be placed across the mouth 70 adjacent the inlet screen 106, the jet 30 will also be obstructed. This is an important benefit because it will tend to push the objectaway at the same time and thus there will be little net suction pulling the object onto the screen 106. This result is accomplished most effectively by placing the outlet end 91 of the nozzle 90 slightly outwardly from the wall 52 of the tub. In this way, the high pressure water is short-circuited to the low pressure side or inlet. The net result is that there is no pressure or suction against the skin.

The motor 72 need not be mounted directly in the unit 26 but can, if desired, be mounted at an angle, e.g., a 90 degree angle to the tub wall and/or the axis of unit 26. The nozzle 90 need not be centered in the inlet, it can if desired be at one side of the inlet. If desired, the inlet defined by screen 106 can be separate from but adjacent to nozzle 90, in which event the nozzle 90 and the inlet screen can each be located, if desired, in separate holes in the side wall of the tub or other vessel. The inlet and jet outlet are in the immediate vicinity of one another and little or no duct work is needed between the pump and the tub. Any kind of drive motor such as an air motor, hydraulic motor or even an internal combustion motor can be used if desired.

Many other variations within the scope of the appended claims will be apparent to those skilled in the art once the principles described above are understood.

What is claimed is:

1. A hydrotherapy jet and water pump assembly for a hot tub, spa, bathtub, whirlpool or pool, said assembly comprising, a unitized water pump, water inlet and hydrotherapy jet outlet nozzle connected together and being mountable through a hole in the wall of said hot tub, spa, bathtub, whirlpool or pool below a functional water line thereof and adapted to extend outwardly from the wall, said assembly having a means for sealing the assembly in the hole in said hot tub, spa, bathtub, whirlpool or pool, said jet outlet nozzle and said inlet being within the assembly adjacent the hole in the hot tub, spa, bathtub, whirlpool or pool wall and both communicating with the interior of the hot tub, spa, bathtub, whirlpool or pool through the hole, whereby water is withdrawn from the hot tub, spa, bathtub, whirlpool or pool through the inlet, the direction of flow thereof is then redirected within the assembly and the water is forced by means of the pump back into the hot tub, spa, bathtub, whirlpool or pool through the jet outlet nozzle in proximity to the water inlet and through the same hole from which water was withdrawn from the hot tub, spa, bathtub, whirlpool or pool into the assembly.

2. The apparatus of claim 1 wherein said pump comprises a centrifugal pump having a mouth at the center thereof, a pump impeller and an outlet at the periphery thereof, a throat adjacent to the mouth of the pump impeller for directing the flow of water into the mouth of the pump impeller and means directing the flow of water from the outlet of the pump impeller into said nozzle.

3. The apparatus of claim 1 wherein an electric drive motor is mounted within the assembly, said drive motor includes an external wall and a plurality of flanges support the motor and said flanges direct at least part of the flow of water from said hot tub, spa, bathtub, whirlpool or pool axially of the motor and thence through said water pump to said jet outlet nozzle.

4. The apparatus of claim 1 wherein the water pump comprises a two stage axial flow impeller/propeller having a plurality of internal first set of propeller blades with a positive pitch and a second set of external blades having a negative pitch to propel water in the opposite direction of the first set and a flow divider ring between the sets of blades for separating two streams of water flowing inwardly and outwardly through the axial flow impeller/propeller.

5. A hydrotherapy jet and pump assembly comprising a waterproof casing, said casing having an inner end portion connectable to a wall of a tub, spa, bathtub, whirlpool or pool for securing the assembly in place, a pump and a pump motor in the casing, a hydrotherapy jet nozzle connected to the pump at the inner end of the casing, a water inlet opening adjacent to the jet nozzle at the inner end of the casing and communicating between the pump and an interior of the tub, spa, bathtub, whirlpool or pool whereby the pump draws water into the casing through the inlet opening and expels it forcefully through the jet nozzle back into the interior of the tub, spa, bathtub, whirlpool or pool to provide a hydrotheraphy action for the user.

6. The apparatus of claim 5 wherein said pump motor is an electric motor, said motor is spaced inwardly within the casing and at least part of the water flows through a space over a surface of the motor before being drawn into the pump to thereby collect heat from the motor and return it to the interior of the tub, spa, bathtub, whirlpool or pool.

7. The apparatus of claim 5 wherein said pump includes a housing with a centrifugal impeller mounted therein, said impeller being connected to said motor and a throat means is provided adjacent the impeller for directing the flow of water into an impeller mouth at the center of said impeller.

8. The apparatus of claim 5 wherein said pump comprises an axial flow multi-bladed pump propeller connected to the motor and mounted within said pump assembly to force water from said water inlet to said jet nozzle.

9. The apparatus of claim 8 wherein the multi-bladed pump propeller has two sets of blades including an outer set with a positive pitch and an inner set with a negative pitch for simultaneously propelling water in two directions whereby water enters the assembly through the inlet, passes through said outer set of said propeller, thence through said inner set of said propeller and into said jet nozzle.

10. A hydrotherapy apparatus comprising, a unitized hydrotherapy jet and pump assembly having a mouth portion communicating with the interior of a hot tub, spa, bathtub, whirlpool or pool below a functional water line thereof, said jet and pump assembly having a hydrotherapy jet nozzle outlet and a water inlet both adjacent to each other in said mouth portion of the assembly, a water pump means within said assembly and communicating between said inlet and said jet nozzle outlet and motive power means connected to the pump to energize the pump for recirculating water by drawing water into the assembly through the inlet and expelling a jet of water into the hot tub, spa, bathtub, whirlpool or pool through the hydrotherapy jet nozzle outlet with substantially no recirculation of said water outside of said hydrotherapy jet and pump assembly.

11. The apparatus of claim 10 wherein said assembly includes a housing comprising a side wall closed upon itself and an end wall at a free end of the side wall, said assembly includes a casing open at said mouth portion and having an outwardly projecting circumferentially extending mounting flange thereon, said mounting flange being mounted upon a wall of said hot tub, spa, bathtub, whirlpool or pool to support the jet and pump assembly and said water pump means having a pump motor connected thereto, said pump motor being located on or within the jet and pump assembly.

12. The apparatus of claim 11 wherein the motor is an electric motor and said pump means draws at least a portion of the water through the inlet over the surface of the motor to cool the motor and return heat recovered therefrom to the interior of the hot tub, spa, bathtub, whirlpool or pool.

13. A hydrotherapy apparatus comprising, a unitized hydrotherapy jet outlet and pump assembly, said assembly having an inlet communicating with the interior of a hot tub, spa, bathtub, whirlpool, or pool similar vessel below a functional water line thereof, said outlet and pump assembly being connected together whereby water expelled from the pump flows directly through the jet outlet and into the vessel and water from the vessel flows directly through the inlet into the pump, air inlet means including an air duct within said assembly and communicating with said outlet introducing air into the water passing through said outlet, and motive power means connected to the pump to energize the pump for drawing water in through the inlet and expelling a jet of water into the vessel through the outlet without circulating said water outside of said hydrotherapy inlet, pump assembly, outlet and vessel.

14. The apparatus of claim 13 wherein said motive power means is an electric motor and said pump assembly and motor are connected rigidly together and supported from a portion of the vessel to which the inlet and outlet are connected.

* * * * *